United States Patent [19]

Delaino

[11] Patent Number: 4,833,745

[45] Date of Patent: May 30, 1989

[54] WATERBED MATTRESS CORNER ACCESSORY

[76] Inventor: G. Thomas Delaino, 3316 NW. 5th Ave., Gainesville, Fla. 32607

[21] Appl. No.: 242,702

[22] Filed: Sep. 9, 1988

Related U.S. Application Data

[63] Continuation-in-part of Ser. No. 021,188, Mar. 3, 1987, Pat. No. 4,769,865.

[51] Int. Cl.[4] ..... A47C 21/02

[52] U.S. Cl. ..... 5/504; 5/508; 24/72.5

[58] Field of Search ..... 5/508, 451, 503, 504, 5/498, 496; 24/72.5

[56] References Cited

U.S. PATENT DOCUMENTS 4,539,723 9/1985 Hillsberry ..... 5/508

4,624,022 11/1986 Dolan ..... 5/508

*Primary Examiner*—Alexander Grosz

[57] ABSTRACT

An accessory usable with a waterbed in a corner to facilitate the application and retention of bed clothes thereto which includes a rigid unitary hollow structure having two vertical substantially planar and triangular side walls disposed at right angles to each other and forming a pyramidal apex adapted to fit into a corner of a bed frame holding a waterbed bladder mattress, and a substantially planar and triangular support surface disposed to receive the weight of a corner of a mattress which pushes the accessory into a corner of a bed frame with bed clothes sandwiched between the side walls and the walls of a bedframe and lower edges of the side walls and a bottom of a bed frame. The bottom edge of the support surface is connected to the side wall bottom edges and define an open bottom communicating with the hollow therein. Preferably the accessory is of a unitary self-locking fiberboard having corrugations extending substantially vertically of the side walls, with the side walls being triple thickness and the support surface being double thickness.

20 Claims, 3 Drawing Sheets

WATERBED MATTRESS CORNER ACCESSORY

RELATED APPLICATIONS

This application is a continuation-in-part application of my copending application entitled Waterbed Mattress Corner Accessory, U.S. Ser. No. 07/021,188, filed Mar. 3, 1987, now U.S. Pat. No. 4,769,865, granted Sept. 13, 1988.

BACKGROUND OF THE INVENTION

The present invention relates to an accessory to facilitate the placing of sheets and/or other bed covers on a waterbed and for retaining these covers in position until they are intentionally removed.

The poorly defined corners and the weight of the waterbed mattress make it difficult to place and maintain sheets on the bed. Even on models having internal flow restrictions, the fluid movement will cause the sheets to slip partially or completely off of the mattress corners.

Fitted sheets for waterbed mattresses are difficult to use because the mattress is very heavy to lift and, when it is lifted, the fluid flows away from the corner leaving an empty bladder corner to be placed in the sheet corner, and when the bladder corner is lowered to the bed frame, the fluid returns and pushes the sheet aside. This problem is compounded when an attempt is made to place more than one bed cover on the mattress like a padded mattress cover which is highly recommended to improve the comfort of a waterbed. However, such cover is almost impossible to place and hold in its intended position along with the sheets. Even if one is successful in finally tucking the bed clothes into place, the next movement of the mattress is very likely to at least partially dislodge them, resulting in excessive wrinkling of the sheet and mattress pad.

Attempts by the prior art to solve the problems defined above have generally failed as set forth more fully in my U.S. Pat. No. 4,769,865, granted Sept. 13, 1988. This invention is directed to providing an improved corner accessory for a waterbed. An improved accessory is provided which may be shipped and/or stored in knock down or flat condition and which may be readily assembled and erected for use without any skilled labor and without the use of connectors, such as nails, staples, tapes, adhesives and the like. The accessory herein provides a structure which is simple in design, rugged in construction and economical to manufacture with a minimum of waste.

BRIEF SUMMARY OF THE INVENTION

The waterbed accessory forms a removable corner between a waterbed bladder mattress and a bed frame and is formed of a rigid structure, four of which are required for a rectangular bed frame. Each structure includes two substantially planar and triangular vertical surfaces which are disposed at right angles to form an apex with one vertical linear edge and two horizontal linear edges diverging outwardly therefrom. Also, the structure has another substantially planar and triangular support surface adapted to receive a corner portion of such mattress bearing downwardly by gravity thereon so that the sides and bottom edges of the two vertical surfaces contact bed clothes for such mattress thereby retaining same in position about the accessory.

The present invention is particularly suited to be constructed of fiberboard or corrugated board which has been cut and scored to form a blank which may be shipped flat and then erected for use by folding along the score lines with selflocking features.

The accessory herein is constructed to provide a support surface of double thickness fiberboard with horizontal corrugations, triple thickness vertical surfaces of fiberboard with vertical corrugations with a double thickness flange portion forming the apex with vertical corrugations, and self-locking tabs and slots located in alignment between respective inner vertical surface and inner support surface.

While the least expensive accessory may be provided by a corrugated blank and folded waterbed accessory, the accessory may be made of other hollow core materials which are of rigid construction such as plastic, but would have an open bottom to permit easy stacking, storing and shipping.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DESCRIPTION OF THE PREFERRED EMBODIMENT OF THIS INVENTION

Figure 1:
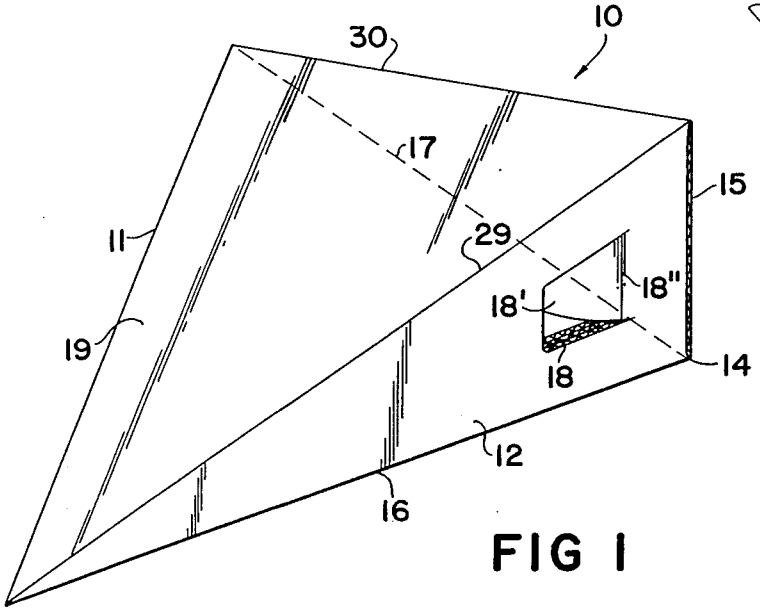
FIG. 1 is a perspective view of the accessory according to the present invention.

This invention is best understood by reference to the accompanying drawings of FIGS. 1–5. FIG. 1 is a perspective view of the present invention wherein accessory 10 is a right angled pyramidal figure of three sides including two vertical substantially planar and triangular surfaces 12 and 13 which are disposed at right angles to form vertical edge 15. The lower horizontal edges 16, 17 of the two vertical planar walls or surfaces 12, 13 intersect with the vertical edge 15 at apex 14 which fits snugly into the corner of a bed frame. Front sloping substantially planar and triangular support surface 19 intersects the other two surfaces 12, 13 along their upper edges 29 and 30 to complete the pyramidal shape. The bottom of the pyramidal shape is an opening formed by lower edges 16 and 17 and by the lower edge 11 of the front sloping surface 19. The openings 18 in the vertical planar surfaces 12, 13 on either side of vertical edge 15 are used to grip the accessory after it is inserted int a fitted corner pocket of a waterbed sheet and as it is being installed under a waterbed mattress and into a corner of a waterbed frame.

Figure 2:
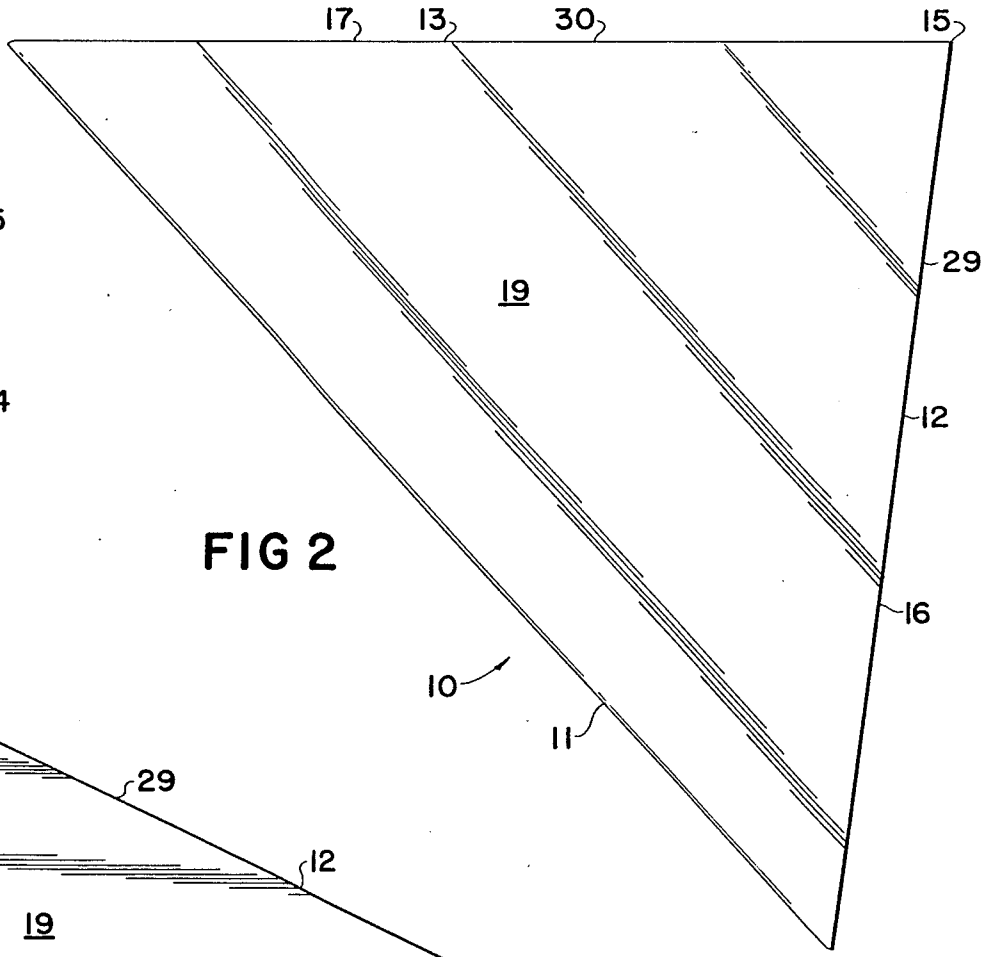
FIG. 2 is a top plan view of the accessory shown in FIG. 1.
Figure 4:
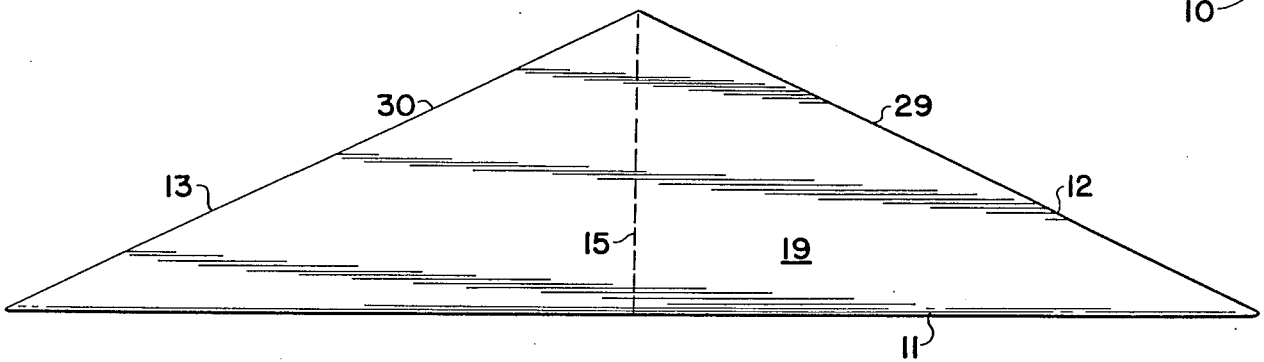
FIG. 4 is a front elevational view of the accessory shown in FIG. 2.
Figure 3:
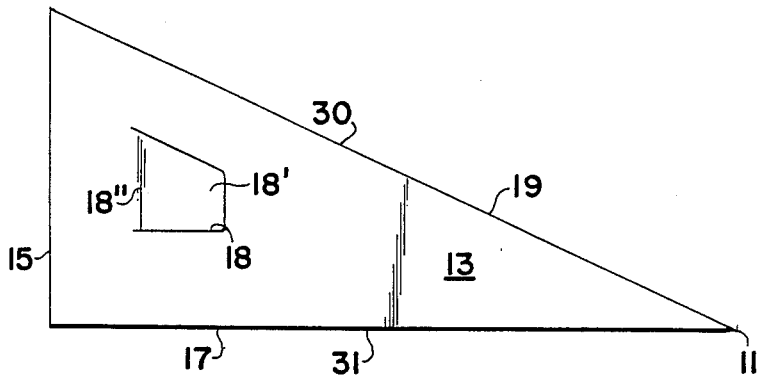
FIG. 3 is a side elevational view of the accessory shown in FIG. 2.

FIG. 2 is a top plan view of the accessory 10 of the invention, as illustrated in FIG. 1. FIGS. 3 and 4 are respective side and front elevational views of the accessory 10. In these drawings the bottom of the pyramidal shape is open and the interior is hollow as will be more clearly understood by reference to FIGS. 6 and 7.

Figure 5:
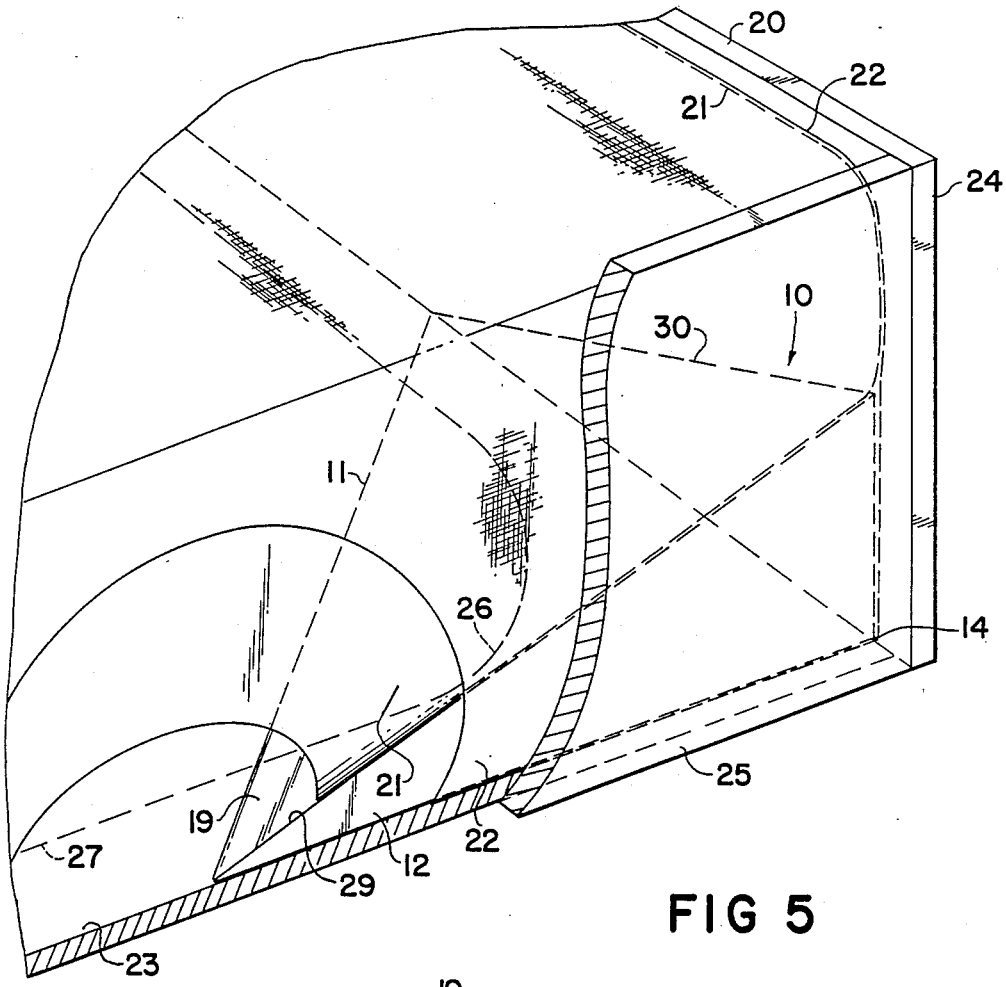
FIG. 5 is a perspective view of the accessory of FIGS. 1–4 as used with a waterbed in a bed frame.

In FIG. 5 there is a perspective view, partially in cross section showing how the accessory 10 in accord with this invention is used with a waterbed. Bed frame 20 is a rectangular box with an open top into which the waterbed bladder mattress 21 is placed. A fitted sheet 22 is to be placed around mattress 21. Corner accessory 10 is placed in the corner of bed frame 20 with apex 14 in the lower corner and sloping face 19 spaced away from apex 14 inwardly of the bed frame 20 so that the corresponding corner of mattress 22 overlies surface 19 tending to push accessory 10 into the corner of the bed frame 20. Fitted sheet 22 with a corner pocket 26 receiving corner accessory 10 therewithin is pushed into the corner of the bed frame by the weight of water in mattress 21. The weight of water also bears down via surface 19 and horizontal edges 11, 16 and 17 upon sheet pocket 26 into engagement with the bottom 23 of bed frame 20 and keeps it from slipping off mattress 21 as the fluid moves around when those persons in bed move or turn over. Also, the sides of the sheet 22 which are engaged by surface 12 and 13 of accessory 10 are pressed against the respective sides 24 and 25 of the bed frame 20.

Figure 6:
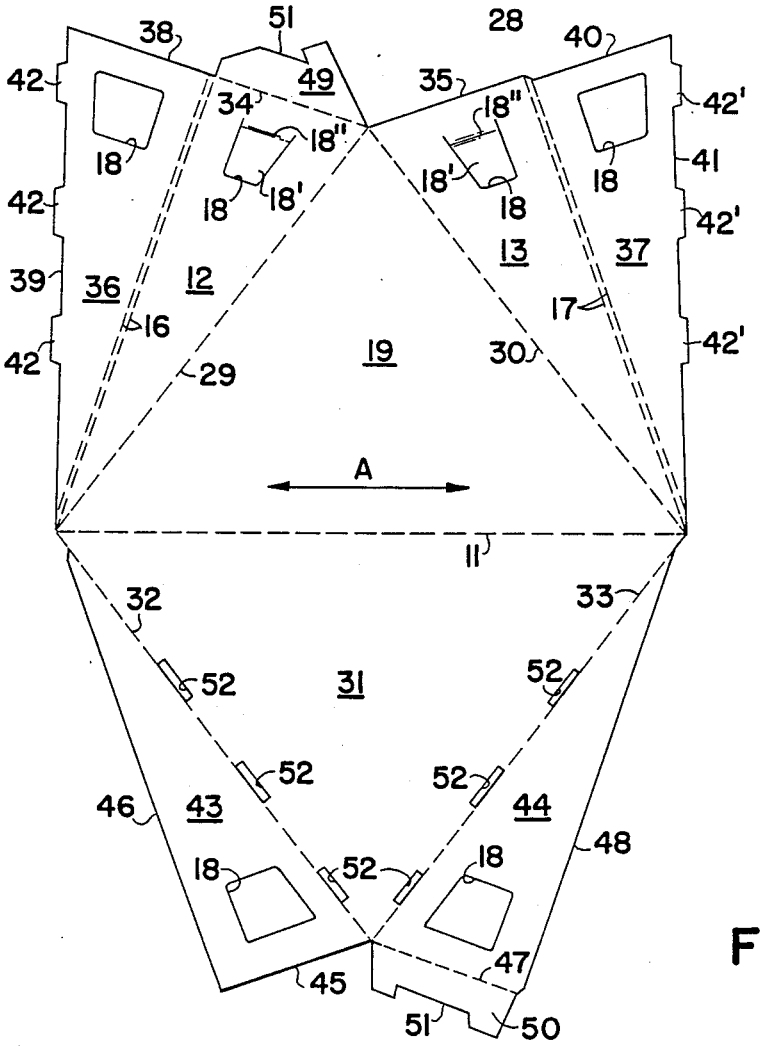
FIG. 6 is a plan view of a blank for forming the waterbed accessory in afford with the invention.
Figure 7:
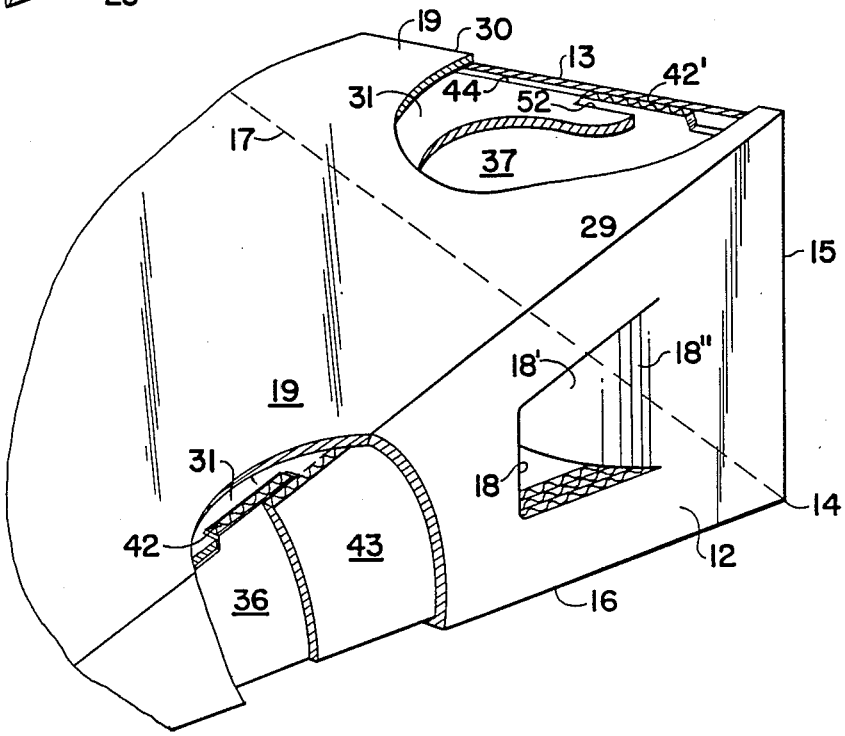
FIG. 7 is a partial perspective view of the assembled waterbed accessory.

The parts of the blank 28, as shown in FIG. 6, are identified with identical reference characters as employed in connection with the respective corresponding parts of the assembled or erected waterbed accessory 10 as shown in FIGS. 1–5. Blank 28 is shown in its completed form after it has been cut from a sheet of single wall corrugated board in the desired peripheral outline with a minimum of waste thereof. The blank 28 has been prescored, as indicated by broken lines, and pre-cut as indicated by full lines, to permit proper manipulation thereof into the waterbed accessory 10.

Blank 28 comprises a central upper panel 19 of triangular shape and defined by fold lines 11, 29 and 30. The center lower panel 31 is defined by fold lines 11, 32 and 33. Triangular side panel 12 extends longitudinally of fold line 29 and is defined by double fold line 16 and fold lines 29 and 34. Triangular panel 13 extends longitudinally of fold line 30 and is defined by double fold lines 17, fold line 30 and by free edge 35. Triangular side panel 36 extends longitudinally of double fold line 16 and is defined by double fold line 16 and free edge lines 38 and 39. Side panel 37 extends longitudinally of double fold line 17 and is defined by double fold line 17 and free edge lines 40 and 41. Side panels 36 and 37 each have three spaced locking tabs 42 and 42' attached along respective free edges 39 and 41.

Triangular side panel 43 extends longitudinally of fold line 32 and is defined by fold line 32 and free edges 45 and 46. Triangular side panel 44 extends longitudinally of fold line 33 and is defined by fold line 33 and 47 and by free edge 48. Locking flap 49 is attached to side panel 12 along fold line 34, and locking flap 50 is attached to side panel 44 along fold line 47. Indentations 51 in locking flaps 49 and 50 are to provide clearance for the finger holes 18, with flaps 18' connected by broken lines 18'' to panels 12 and 13 being passed through the other aligned finger holes 18, in all of the side panels 12, 13, 36, 37 and 43, 44, with flaps 18' being connected by broken lines 18'' to panels 12 and 13 which are bent and passed through the other aligned finger holes 18, when the accessory is assembled. The lower center panel 31 is provided with spaced elongated openings 52 which will align with respective spaced locking tabs 42 and 42' when the accessory is assembled. In accord with this invention, self-locking means are thus provided by at least one locking tab 42, and 42' engaging within openings 52 and/or flaps 18' being folded inwardly to engage within aligned openings or finger holes 18.

The blank 28 is transformed into the fully set-up or assembled waterbed accessory 10, shown in FIG. 1, by the exemplified manipulative steps hereinbelow. First, the center lower panel 31 is folded substantially 180° upward along fold line 11 to lie adjacently outwardly of and parallel to center upper panel 19. Side panels 43 and 44 are folded substantially 90° upwardly along respective fold lines 32 and 33 to assume a vertical position. Locking flap 50 is folded along fold line 47 around to engage side panel 43. Side panel 12 and its attached side panel 36 are folded substantially 90° upwardly along fold line 29 to a position outward of and adjacent to side panel 43 with flap 50 being sandwiched between side panels 43 and 12. Side panel 36 is folded substantially 180° downwardly along double fold line 16 and over side panel 43 to dispose the respective locking tabs 42 into openings 52. Locking flap 49 is folded along fold line 34 and around to engage side panel 44. Side panels 13 and its attached side panel 37 are folded substantially 90° upwardly along fold line 30 to a position outward of and adjacent to side panel 44 with flap 49 being sandwiched between side panels 44 and 13. Side panel 37 is folded substantially 180° downward along double fold line 17 and over side panel 44 to cause insertion of the locking tabs 42' into openings 52. Flaps 18' connected to side panels 12 and 13 are folded along fold lines 18'' inwardly substantially 90° through finger holes 18, thereby completing the waterbed accessory 10 as depicted in FIG. 1.

The corrugations in the blank 28 are indicated by arrow A. In the assembled condition of the accessory 10, the corrugations in all side panels are substantially vertical thereby providing the accessory with enhanced strength to sustain vertical weights caused by the mattress 21 and anyone sitting directly thereover. While single wall corrugated board is specifically shown and described herein, it will be apparent that other types of board suitable for the accessory may be substituted if desired.

Generally, the accessory should be from about 3–6 inches in height, preferably about 4 inches; and each lower edge of the vertical surfaces, e.g., edges 16 and 17 of FIG. 1 to be about 8–15 inches, preferably about 12 inches. While the accessory of this invention is shown as having several sharp corners, it is understood that all of the corners of the devices disclosed herein should be rounded to minimize damage to bed clothes and/or the bladder mattress, and this can be easily accomplished by merely slightly banging any sharp corner on the floor, or door frame, or the like.

Two techniques are available for utilizing the corner stabilizing accessories of this invention to ease the process of placing sheets and/or other bed covers on a waterbed. The first technique would be to position an accessory in each of the four corners of the waterbed similar to that shown in FIG. 5. The sheet and/or bed covers are then tucked around and under the corners in much the same manner used when placing sheets on a normal inner-spring bed. This technique would be necessary if conventional (flat) bed covers are being used.

It also works well when using fitted waterbed sheets and/or other bed covers.

The second technique entails the placement of the corner stabilizing accessory inside the fitted corner of a waterbed sheet and/or other bed cover. The waterbed mattress is then rolled back away from the corner of the retaining frame to allow the stabilizing accessory (with bed covers) to be placed in the corner. The mattress is then released and allowed to roll back against or onto the stabilizing accessory. This technique is very useful when placing more than one bed cover (i.e., a sheet and mattress cover) on the waterbed or when placing bed covers on a waterbed that has been positioned in a corner of a room, thereby restricting access to such corner of the waterbed.

Thus an integral blank is provided for folding into a hollow waterbed accessory which is adapted to form a corner to facilitate the application and retention of bed clothes to a waterbed mattress in a waterbed frame. As clearly seen in FIG. 6 a triangular support surface 19 has an elongated bottom edge 11 with oppositely disposed ends connected to elongated side edges. A pair of outer triangular side walls 12, 13, each including a pair of elongated side edges 29, 16 and 30, 17 one side edge 29 and 30 being connected by fold lines to a respective side edge 29, 30 of the support surface 19. A pair of inner triangular side walls 36, 37 includes a pair of elongated side edges 16, 39 and 17, 41 one side edge 16, 17 of which being connected by fold lines to another of the respective side edges 16, 17 of the outer side walls 12, 13. A flap 49 is connected to one of the outer side walls 12, 13 between its two elongated side edges 29, 16 or 17, 30 and such flap is adapted to be nested between the other outer side wall 13 or 12 and its connected inner side wall 37 or 36 when the inner and outer side walls 12, 13, 36 and 37 are positioned substantially at right angles to the support surface 19. The fold lines 16, 17 between the inner and outer side walls 12, 13 and 36, 37 forming elongated bottom edges 16, 17 for the inner and outer side walls 12, 13 and 36, 37 and with the bottom edge 11 of support surface 19 defines an open bottom communicating with the hollow of the accessory. Integral self-locking means in the form of locking tabs 18' and openings 18 and/or at least spaced tabs 42, 42' cooperating with slots 52, maintaining the side walls perpendicular.

It should be apparent, that if it were found to be unnecessary for enhanced stacking strength and weight capabilities, the integral blank 28 may be cut along edge or line 11 and support surface 31 and attached side walls 43, 44 and flap 50 not be used. In such event, assuming tabs 42 and 42' were to be employed, the openings 52 presently in support surface 31 would be provided in substantially correspondingly spaced openings in support surface 19. Such a blank may be provided if double corrugated fiberboard were employed, for example.

However, it is preferred that the blank include another triangular support surface 31 having another elongated bottom edge 11 coextensive and connected by a fold line with the bottom edge 11 of the support surface 19. The other support surface 31 is thus folded against the support surface 19 so that the support surfaces 19 and 31 are substantially parallel and coextensive to provide enhanced weight supporting capabilities to the accessory.

Medial triangular side walls 43 and 44 are connected by fold lines 32, 33 to the other support surface 31 which generally intersect with the fold line 11 between the support surfaces 19 and 31 and each medial side wall 43 and 44 is disposed and sandwiched between the inner side wall 36, 37 and its attached outer side wall 12, 13 when erected. Also, another flap 50 is connected by a fold line to one of the other side walls 43, 44 and being disposed to be extended partially about another of such other side walls when the other side walls are positioned substantially perpendicular to the other support surface 31. The other flap 50 forms with the flap 49 a double strength corner for the erected accessory and provides rigidity and great weight capabilities to the entire structure.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to be secured by Letters Patent of the United States is:

1. A hollow waterbed accessory adapted to form a corner comprising a triangular planar support surface having three edges and two depending triangular planar side surfaces extending substantially vertically from two of said edges of said support surface and having respective bottom edges, means for connecting said two planar side walls together to form a substantially vertically extending edge, said support surface having an elongated bottom edge between said two side edges of said support surface connected at respective ends thereof to respective said bottom edges of said two side walls, said bottom edge of said support being remote from said vertically extending edge, said support surfaces and said side walls and said means for connecting said two planar surfaces forming a hollow wedge having an open bottom defined by said bottom edges of said side walls and said support surface and communicating with the hollow thereof, said support surface being adapted to receive a portion of a waterbed mattress bearing downwardly by gravity thereon, said accessory being positionable in a lower corner of a frame of a waterbed between bed clothes and a waterbed mattress to facilitate the application and retention of bed clothes on a waterbed mattress in a waterbed frame.

2. The accessory of claim 1 wherein said vertically extending edge and said two edges of said support surface substantially are in vertical alignment and form an apex, said apex being rounded to inhibit inadvertent damage to a waterbed mattress and bed clothes.

3. The accessory of claim 2 wherein intersections formed between said bottom edge of said support surfaces and said bottom edges of said two side walls are rounded to inhibit inadvertent damage to a waterbed mattress and bed clothes.

4. The accessory of claim 1 further comprising another triangular support surface extending substantially coextensive beneath and parallel to said support surface to enhance the weight supporting capabilities of said accessory.

5. The accessory of claim 4 further comprising another pair of planar side walls connected to said other support surface and extending substantially perpendicular thereto, said other pair of side walls being adapted to be positioned between said two side walls and respectively engaging and being parallel thereto.

6. The accessory of claim 5 further comprising an inner planar side wall connected to each of said two side walls, said two side walls forming respective outer side walls and said pair of side walls forming respective medial walls, each said medial wall being disposed between respective said outer wall and its connected said inner wall.

7. The accessory of claim 6 wherein said means for connecting said two planar side walls includes a laterally extending flap connected to one said outer wall adjacent an intersection between said two edges of said support surface, said flap extending to a position between another said outer wall and one said medial wall when said accessory is fully erected.

8. The accessory of claim 7 further comprising another laterally extending flap connected to one said medial wall adjacent an intersection between two edges of said other support surfaces which is adjacent said intersection between said two edges of said support surface, said other flap extending between said one outer wall and another said medial wall when said accessory is fully erected.

9. The accessory of claim 8 further comprising locking means for maintaining all of said side walls in their substantially perpendicular relationship with respect to said support surfaces.

10. The accessory of claim 9 wherein said locking means includes at least one laterally extending tab connected to each of said inner side walls, and at least one opening in said other support surface along each said medial side wall and being aligned with each said tab when respective said tab extends into respective said opening.

11. The accessory of claim 9 wherein said locking means includes a plurality of spaced tabs connected to and along an elongated free edge of each said inner side wall, and a plurality of spaced openings in said other support surface along each said medial side wall and being aligned with respective said tab when extended into respective said opening.

12. The accessory of claim 11 wherein respective said inner wall is folded about respective said medial wall and respective said inner wall and outer wall sandwiches therebetween said medial wall and one of said flaps.

13. The accessory of claim 5 further comprising locking means for maintaining all of said side walls in their substantially perpendicular relationship with respect to said support surfaces.

14. The accessory of claim 13 wherein said locking means includes at least one tab in each of said two side walls and at least one opening in each of said pair of side walls and being in alignment with respective said tab when all of said side walls are in their substantially perpendicular relationship, said tabs being bendable into respective said openings thereby locking said side walls together and forming finger holes for grasping said accessory for ready manipulation thereof.

15. An integral blank for folding into a hollow waterbed accessory adapted to form a corner to facilitate the application and retention of bed clothes to a waterbed mattress in a waterbed frame, said blank comprising a triangular support surface having an elongated bottom edge with opposite ends and elongated side edges, a pair of outer triangular side walls each having a pair of elongated side edges one of which being connected to respective said side edges of said support surface by fold lines, a pair of inner triangular side walls having a pair of elongated side edges one of which being connected to another respective said side edges of said outer side walls by fold lines, a flap connected to one of said outer side walls between its said two elongated edges, said flap being adapted to be nested between another said outer side wall and its connected said inner side wall when said inner and outer side walls are positioned substantially at right angles to said support surface, said fold lines between said inner and outer side walls forming elongated bottom edges for said inner and outer side walls and with said bottom edge of said support surface defining an open bottom communicating with said hollow of said accessory and integral self-locking means for maintaining said side walls perpendicular.

16. The blank of claim 15 further comprising another triangular support surface having another elongated bottom edge coextensive and connected with said bottom edge of said support surface by a fold line, said another support surface being folded against said support surface so that said support surfaces are substantially parallel and coextensive to provide enhanced weight supporting capabilities to said accessory.

17. The blank of claim 15 wherein said self-locking means includes at least one laterally extending tab integral with each of said inner side walls aligned with a cooperating opening in said other support surface.

18. The blank of claim 16 wherein said self-locking means includes a tab integral with and connected by a fold line in each of said outer side walls and insertable in an aligned opening in each said inner side wall to lock said accessory in its erected condition and to provide finger holes for grasping said accessory for ready manipulation thereof.

19. The blank of claim 16 further comprising medial triangular side walls connected to said other support surface by fold lines which generally intersect with said fold line between said support surfaces, each said medial side wall being disposed and sandwiched between said inner and its attached outer side walls.

20. The blank of claim 18 further comprising another flap connected by a fold line to one of said other side walls and being disposed to be extended partially about another of said other side walls when said other side walls are positioned substantially perpendicular to said other support surface, said other flap forming with said flap a double strength corner for said accessory.

* * * * *